United States Patent [19]

Michel et al.

[11] 4,148,387

[45] Apr. 10, 1979

[54] SWITCH FOR WIRE AND REFINED IRON MILLS

[75] Inventors: Rolf Michel, Drensteinfurt; Jörn Moslener, Dusseldorf, both of Fed. Rep. of Germany

[73] Assignee: DEMAG Aktiengesellschaft, Duisburg, Fed. Rep. of Germany

[21] Appl. No.: 805,117

[22] Filed: Jun. 9, 1977

[30] Foreign Application Priority Data

Jun. 12, 1976 [DE] Fed. Rep. of Germany ..... 2626476

[51] Int. Cl.[2] ..... B65G 11/20; B21B 41/00

[52] U.S. Cl. ..... 193/39; 72/231

[58] Field of Search ..... 193/39, 31 A; 72/231

[56] References Cited

U.S. PATENT DOCUMENTS

| | | | |
|---|---|---|---|
| 440,696 | 11/1890 | Daniels | 193/39 |
| 1,915,714 | 6/1933 | Bletso | 193/39 |
| 2,251,596 | 8/1941 | O'Malley | 193/39 |
| 3,073,426 | 1/1963 | Hill et al. | 193/39 |
| 3,228,505 | 1/1966 | Leitner | 193/39 |

*Primary Examiner*—Robert B. Reeves
*Assistant Examiner*—Jeffrey V. Nase
*Attorney, Agent, or Firm*—Mandeville and Schweitzer

[57] ABSTRACT

The invention relates to a switch for wire mills and refined iron mills for selecting one of two or more continuing tubular guides for rolled material arriving successively in one guide. A guide tube is used which may be oriented at the inlet orifices of the continuing guides, and which is connected to the arrival guide, whereby the guide tube may be set, while a rolled material strand is being forwarded to one of the continuing guides, for one of the other continuing guides.

3 Claims, 4 Drawing Figures

SWITCH FOR WIRE AND REFINED IRON MILLS

BACKGROUND OF THE INVENTION

Switches of the kind described serve to direct rolled material arriving from the rolling mill alternately to two reels, in most cases coordinated with one core. Furthermore, such switches are used in order to direct the incipient ends—severed by means of preceding shears—to a scrap bin or chopper. As modern rolling mills are operated at very high speeds, there is not sufficient time to actuate the switch after a strand end has passed, and before arrival of the beginning of the next strand. For this reason, the switching is done while a strand is being forwarded into one of the continuing guides, to the other guide into which the following strand is to enter. In order to facilitate this procedure, it is necessary to design the switch in such a fashion that the strand still passing through the already reversed switch is not subjected to excessive deflection. The guide elements surrounding the strand must, therefore, have sufficient clearance. This necessitated, in the past, steps taken to direct the newly arriving strand head safely in the new direction without having the previously passing strand end swing sideways in uncontrollable fashion (lash effect).

In a switch of the type described, the end of the adjustable guide tube is fitted with a swiveling funnel, whose funnel opening looks towards the direction from which the rolled material arrives, and which is maintained by springs in the direction of the guide tube. Once the guide tube, after the strand has entered the continuing course through the guide tube and through the funnel, all being aligned, is switched to the other course, the funnel will assume an oblique position due to the adjusting forces of the passing strand. As soon as the strand end has passed the funnel, the latter springs into the new position coaxial with the guide tube. Thus, the beginning of the next strand is guided to the other direction.

The known installation has the disadvantage that between the forward strand end and the following strand beginning a certain minimum distance must be maintained, as the funnel may only then snap into the new position if it has been released by the strand that has passed. If the funnel is furnished with strong springs in order to have the switching process take place as abruptly as possible, the deflection force to be applied by the strand end still passing through is increased, thus preventing the risk of bending the strand end. For reliable guidance of the funnel, it must have a minimum length, thus maintaining a certain distance between the passing strands. All these prerequisites make it impossible for this kind of switch to be utilized for rolled material running at extreme speed, where the distances between strand ends and beginnings are very short.

STATEMENT OF THE INVENTION

The object of the invention is to improve upon the switch initially mentioned, so as to guide the rolled material to the respective desired direction, even at highest speeds and shortest distances between strand end and beginning. This problem is solved so that the longitudinal axis of the guide tube outlet portion only swivels essentially around the intersection of the continuing guides axes into positions coaxial with the latter, and that the guide tube outlet side ends leaving a free space before the beginning of the inlet orifices of the divergent continuing guides.

The invention is based on the new concept that the direction of the new strand can be altered practically independently from rolled material speed, and the distance between a preceding strand end and a succeeding strand forward end by providing a void between the guide tube end and the branching part of the switch, whereby the length of such void depends upon the deflection capacity of the passing material, and through which the beginning of the new strand is "shot" with the desired new direction. In order to maintain the initial position of the strand beginning before the start of the void between the delivery tube and the guide tube, practically unchanged for all switch positions, the guide tube mouth—contrary to all previous concepts in switching procedures—is essentially kept stationary, while the setting of the guide tube axis for the new direction is done by displacing the guide tube portion pointing away from the mouth. Suitably, the guide tube of the switch, as per the present invention, consists of hinged, interconnected straight parts which can be adjusted to a linear and an angular position.

In accordance with a practial proven design, the guide tube is made up of three parts, the central part of which can be displaced across its longitudinal direction by means of a power drive. In order to keep to a minimum the deflection of the strand still passing through in the old direction after switching has occurred, it is recommended to arrange the axes of the continuing guides at an angle of 10° maximum to each other.

An example of the invention is shown in the drawings, as follows:

DETAILED DESCRIPTION OF A PREFERRED EMBODIMENT

Figure 1:
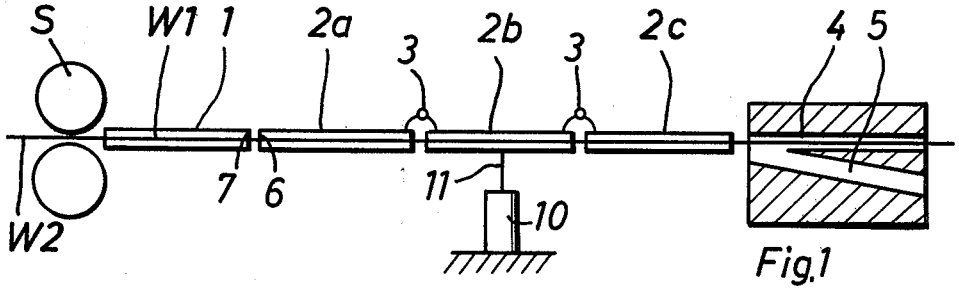
FIG. 1 is a schematic illustration of a switch embodying the invention and showing a conformed billet passing through the switch in a straight direction.

The switch shown schematically in the drawings is supplied with rolled material through a stationary tubular guide 1, arranged behind shears marked S. The switch itself consists of three straight tubular portions 2*a*, 2*b*, 2*c*, whose ends are flexibly joined at 3. The continuing guides following guide tube 2*a* through 2*c* are marked 4 and 5. To adjust the guide tube, and thus the switch itself, a power drive is used consisting of a piston cylinder unit 10, whose piston rod 11 engages at the central portion 2*b* of the guide tube.

In FIG. 1, a first rolled material strand W1 has passed shears S, which severed it from the following rolled material strand W2. Strand W1 passes the guide tube portions aligned in succession and is then directed straight to continuing guide 4. While strand W1 is still passing through the switch, the latter is shifted to the positions of FIG. 2, whereby guide tube portion 2*c* aligns with branching continuing guide 5.

Figure 2:
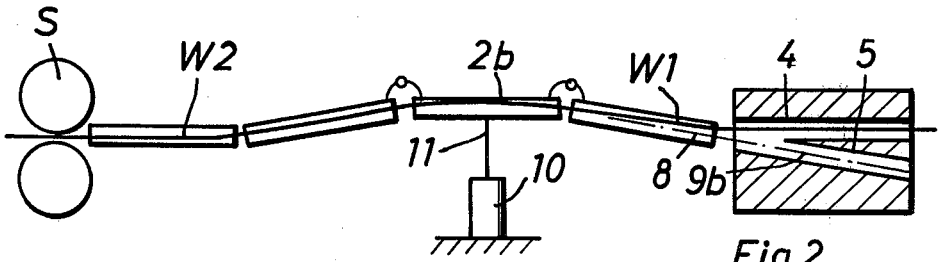
FIG. 2 is the switch of FIG. 1 in another position, and showing the passage of the end of the billet shown in FIG. 1, after the switching action.

As shown in FIG. 2, this change-over is done by moving central portion 2b of the guide tube across from its original position. The outlet of guide tube portion 2c is pivoted around a point located at the front part of such tube portion, so that axis 8 of this tube portion aligns with axis 9b of the continuing guide. Strand W1 still passing into the continuing guide is thus subjected to very little deflection.

Figure 3:
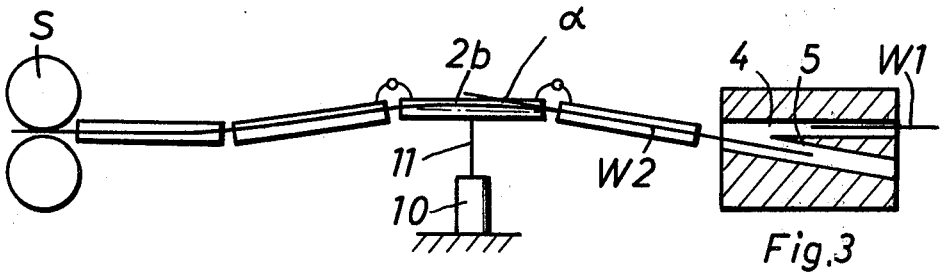
FIG. 3 is the switch of FIG. 1, still in the position shown in FIG. 2, during the entry of a succeeding billet.
Figure 4:
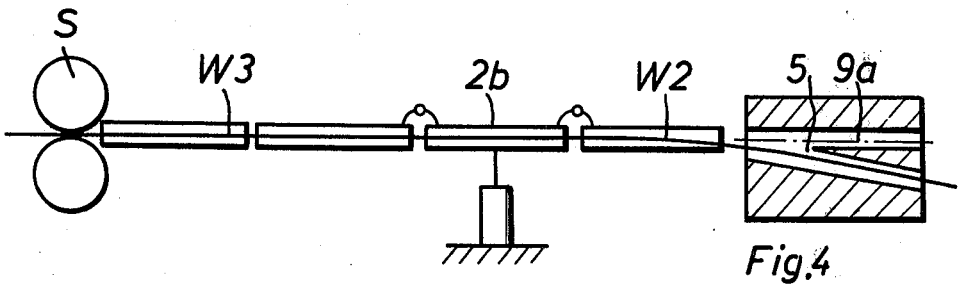
FIG. 4 is the switch of FIG. 1, in the initial position, and showing the continued passage of the succeeding billet after the second switching action.

The moment the beginning of new strand W2 leaves tube portion 2c, it enters continuing guide 5, even at highest possible speed, without any problems, and this is so even if there is no spacing whatsoever to the rear end of the preceding strand. This phase of the operation is shown in FIG. 3. In order to prepare the change of direction to the direction to be taken by strand W3, the switch is changed to the position shown in FIG. 4, while strand W2 is still passing through. Thus, strand W2 is subject to little deflection at or in guide tube portion 2c. The beginning of new strand W3 leaves guide tube portion 2c in the given direction and enters continuing guide 4, as now axis 8 of tube portion 2c is aligned with axis 9a of guide 4.

The proposed switch has the special advantage that there is little deflection of the rolled material strand between the outlet portion of tube 2c and the respective guide after changeover of the switch to the new direction. As deflection occurs only to one side, the usual "lash effect" does not take place, such as intense striking of the bent strand end against the switch parts. It has proven favorable to select the angle around which the outlet portion of guide tube 2c pivots, not greater than 10°. Accordingly, the axes 9a and 9b of guides 4 and 5 must also include an angle of maximum 10°.

The construction of the switch schematically shown in the drawings is extremely simple, as we are dealing merely with flexibly joined tubular parts which are roughly in the center, set from a straight course to a somewhat arched course, while their ends maintain their position. Practical tests have shown rolled material speeds of 50 m/sec can be handled without difficulty by a switch consisting of tubular portions of only about 150 to 300 mm length, so that there is practically no distance left between the individual strands due to the high severing speed of the shears utilized.

We claim:

1. An apparatus for directing continuously successively formed several strands to two or more exit paths, comprising (a) a plurality of connected together articulated tubes defining an arrival guide for continuously directing said severed strands to said paths;

(b) the last of said tubes adjacent said exit paths being a guide tube and movable from one of said exit paths to another exit path;

(c) the entry end of said guide tube being positioned adjacent the exit end of the preceding tubes forming said arrival guide for receiving said severed strands;

(d) a plurality of continuing guides defining said exit paths; the improvement characterized by (e) the axes of said continuing guides diverging from a point internally of said guide tube, said point being spaced from the outlet end of said guide tube;

(f) said outlet end of said guide tube being spaced from the entry end of said plurality of continuing guides; and (g) means for pivoting said guide tube around said point so that the axis of said guide tube is coaxial with the axis of one of said continuing guides in each of its positions of movement prior to feeding of a succeeding strand thereto;

(h) whereby succeeding strands are fed in a straight line from said guide tube to each of said continuing guides along one of said diverging axes.

2. Apparatus according to claim 1, further characterized by (a) said arrival guide comprised of three straight sections;

(b) the central section of said arrival guide displaceable transverse of its longitudinal axis; and (c) a reversible power drive connected to said central section for the displacement thereof.

3. Apparatus according to claim 1, further characterized by (a) the diverging axes of said continuing guide tubes being at an angle of 10 degrees or less.

* * * * *